US010873130B2

(12) United States Patent
Leng et al.

(10) Patent No.: US 10,873,130 B2
(45) Date of Patent: Dec. 22, 2020

(54) PHASED ARRAY ANTENNA SYSTEM AND MOBILE TERMINAL USING SAME

(71) Applicant: AAC Technologies Pte. Ltd., Singapore (SG)

(72) Inventors: Goh Hui Leng, Shenzhen (CN); Ng Guan Hong, Shenzhen (CN); Tay Yew Siow, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 360 days.

(21) Appl. No.: 15/955,807

(22) Filed: Apr. 18, 2018

(65) Prior Publication Data

US 2019/0181548 A1 Jun. 13, 2019

(30) Foreign Application Priority Data

Dec. 13, 2017 (CN) ..... 2017 1 1327435

(51) Int. Cl.
*H01Q 1/38* (2006.01)
*H01Q 3/38* (2006.01)
(Continued)

(52) U.S. Cl.
CPC ..... *H01Q 3/38* (2013.01); *H01Q 1/38* (2013.01); *H01Q 3/2658* (2013.01); *H01Q 21/065* (2013.01)

(58) Field of Classification Search
CPC ..... H01Q 25/00; H01Q 25/04; H01Q 25/005; H01Q 1/38; H01Q 3/26; H01Q 3/2617;
(Continued)

(56) References Cited

U.S. PATENT DOCUMENTS 6,388,610 B1 * 5/2002 Przyjemski ..... G01S 19/215 342/357.27
7,903,030 B2 * 3/2011 Nagai ..... H01Q 9/0407 343/700 MS
(Continued)

FOREIGN PATENT DOCUMENTS

JP 2001119230 A1 4/2001

OTHER PUBLICATIONS

1st Office Action dated Dec. 20, 2019 by SIPO in related Chinese Patent Application No. 201711327435.7 (6 Pages).

*Primary Examiner* — Dimary S Lopez Cruz
*Assistant Examiner* — Patrick R Holecek
(74) *Attorney, Agent, or Firm* — IPro, PLLC; Na Xu

(57) ABSTRACT

The invention relates to the technical field of communication and discloses a phased array antenna system and a mobile terminal. In the invention, the phased array antenna system includes a first group of antenna unit arrays and a second group of antenna unit arrays, wherein the beam radiated by the first group of antenna unit arrays covers the a first half space, and the beam radiated by the second group of antenna unit arrays covers a second half space, the first half space and the second half space constitutes an omnidirectional space. The phased array antenna system provided by the invention and the mobile terminal achieve the full coverage of the phased array antenna around the mobile terminal, thereby improving the signal sending-receiving efficiency of the mobile terminal.

7 Claims, 6 Drawing Sheets

(51) Int. Cl.
*H01Q 3/26* (2006.01)
*H01Q 21/06* (2006.01)

(58) Field of Classification Search
CPC ..... H01Q 3/2658; H01Q 3/30; H01Q 3/34; H01Q 3/36; H01Q 3/38; H01Q 21/065; H01Q 21/205; H01Q 21/28; H01Q 21/29; H01Q 21/293; H01Q 9/045
See application file for complete search history.

(56) References Cited

U.S. PATENT DOCUMENTS

2016/0301129 A1* 10/2016 Ying ..... H01Q 21/08
2018/0309198 A1* 10/2018 Yu ..... H01Q 1/243

* cited by examiner

PHASED ARRAY ANTENNA SYSTEM AND MOBILE TERMINAL USING SAME

FIELD OF THE PRESENT DISCLOSURE

The embodiment of the invention relates to the field of communication technology, in particular to a phased array antenna system and a mobile terminal using such an antenna system.

DESCRIPTION OF RELATED ART

With the rapid growth of the number of mobile end users, whereas the omnidirectional antenna typically used in the omnidirectional antenna in $4^{th}$ generation (4G) mobile communication network cannot be applied in $5^{th}$ (5G) mobile communication network, the use of new millimeter-wave bands in mobile communications will be considered in the future $5^{th}$-generation (5G) mobile communication networks. However, one of the main disadvantages of using millimeter-wave band in mobile communication is the huge transmission loss. Based on this, the antenna of mobile terminal used in 5G mobile communication network needs to have high gain to compensate the transmission loss caused by using millimeter-wave frequency band. The phased array antenna is composed of a plurality of antenna units associated with the phase shifter (also known as antenna radiation unit), which has a higher gain than the omnidirectional antenna. The phased array antenna can gather the beam and direct it to the direction of destination. Therefore, the phased array antenna is considered as an antenna for a 5G mobile terminal.

The inventor finds out that there are at least the following problems in the prior art: at present, the typical application is linear phased array antenna, that is, antenna unit linear array which can be patched to obtain the phased array antenna. Different from omnidirectional antenna, the linear phased array antenna can only cover one direction of the whole space, and cannot achieve the overall coverage around the mobile terminal, which will lead to the decline of the signal transmission and transmission efficiency of the mobile terminal.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

In order to achieve the full coverage of the phased array antenna system around the mobile terminal, the embodiment of the invention provides a phased array antenna system. The design idea of the phased array antenna system is that at least a first group of antenna unit arrays and a second group of antenna unit arrays are arranged, wherein the beam radiated by the first group of antenna unit arrays covers a first half space, and the beam radiated by the second group of antenna unit arrays covers a second half space, and the first half space and the second half space form a omnidirectional space. In particular, the first group of antenna unit arrays achieve beam scanning in the first half space, and the second group of antenna unit arrays achieve beam scanning in the second half space. The phased array antenna system based on this idea can achieve full coverage around the mobile terminal, which overcomes the problem that the existing linear phased array antenna can only cover one direction of the whole space instead of full coverage around the mobile terminal, and the signal transmission efficiency of the mobile terminal can be improved, thus it can be applied to the millimeter wave communication of the mobile terminal in the 5G mobile communication network.

The design of the phased array antenna system is described in detail by several specific embodiments as below.

Figure 1:
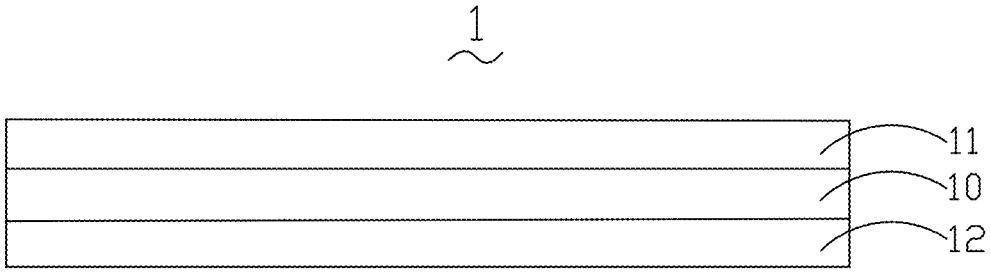
FIG. 1 is a schematic diagram of a phased array antenna system according to a first embodiment of the present invention.

The first embodiment of the invention relates to a phased array antenna system 1. The specific configuration of the phased array antenna system 1 is shown in FIG. 1, and in particular includes a first group of antenna unit arrays 11 arranged on one side of the printed circuit board 10, and a second group of antenna unit arrays 12 arranged on the other side of the printed circuit board 10, wherein the second group of antenna unit arrays 12 and the first group of antenna unit arrays 11 present a mirror image distribution. The beam radiated by the first group of antenna unit arrays 11 covers the first half space, and the beam radiated by the second group of antenna unit arrays 12 covers the second half space, and the first half space and the second half space constitute an omnidirectional space. The first group of antenna unit arrays 11 achieves beam scanning in the first half space and the second group of antenna unit arrays 12 achieves beam scanning in the second half space.

In the present embodiment, the first half space and the second half space are divided by the circuit board as the boundary for the omnidirectional space, and the first half space refers to the space in which the circuit board faces the side of the first group of antenna unit arrays 11, and the second half space refers to the space in which the circuit board faces one side of the second group of antenna unit arrays 12.

Where, the first group of antenna unit arrays 11 is an array comprising a plurality of antenna units arranged linearly, similarly, the second group of antenna unit arrays 12 is the same as the first group of antenna unit arrays 11.

Where, the antenna unit is also known as the antenna radiation unit, that is, the radiation phase of the antenna unit can be adjusted through the control of the phase shifter, thus the direction of the main lobe of the antenna unit can be adjusted.

The first group of antenna unit arrays 11 and the second group of antenna unit arrays 12 radiate electromagnetic energy into the surrounding space at a predetermined frequency and a predetermined data bandwidth.

In the phased array antenna system 1 provided by the first embodiment, the first group of antenna unit arrays 11 and the second group of antenna unit arrays 12 are arranged on both sides of the printed circuit board with a mirror image distribution, which makes the first half space covered by the first group of antenna unit arrays 11 and the second half space covered by the second group of antenna unit arrays 12 complement each other, in order to cover the omnidirectional space composed of the first half space and the second half space around the mobile terminal, thus overcoming the problem that the existing linear phased array antenna can only cover one direction of the whole space instead of full coverage around mobile terminals. Moreover, because the omnidirectional space coverage can be achieved around the mobile terminal, the terminal can receive and transmit signals in any direction, thus improving the signal receiving and transmitting efficiency of the mobile terminal. Because of the high gain characteristic of phased array antenna, it can be used to compensate the transmission loss caused by millimeter wave. The phased array antenna provided by the embodiment of the invention can be applied to the millimeter wave communication of the mobile terminal in the 5G mobile communication network, and achieve full coverage while compensating the transmission loss caused by the millimeter wave.

Figure 2:
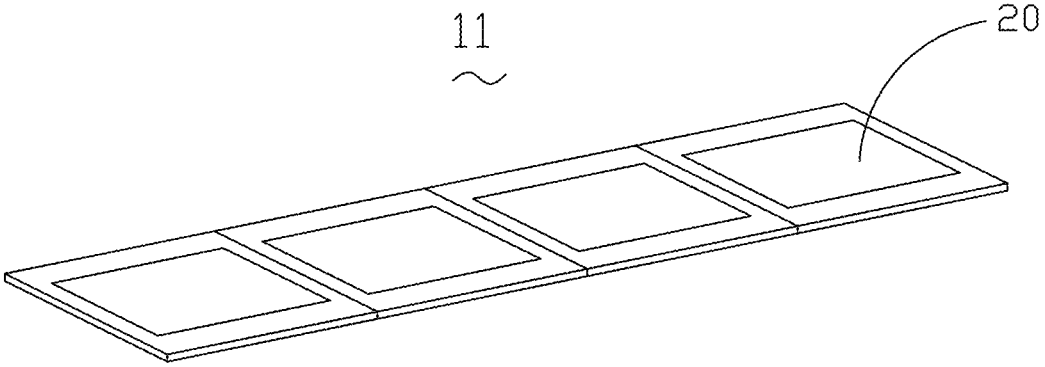
FIG. 2 is a structural diagram of a first group of antenna unit arrays according to a second embodiment of the present invention.

The second embodiment of the invention relates to a phased array antenna system 1, and the second embodiment details a specific structure of the phased array antenna system on the basis of the first embodiment. The relevant technical details mentioned in the first embodiment are still valid in the present embodiment and will not be restated herein in order to reduce duplication. In the second embodiment, the first group of antenna unit array 11 is composed of N antenna units 20 arranged in a row; the second group of linear antenna units 12 arrays is composed of N antenna units 20 arranged in a row; where N is an integer greater than 1. Preferably, N=4. A structural diagram of the first group of antenna unit arrays 11 or the second group of antenna unit arrays 12 as shown in FIG. 2 is illustrated only with N=4 as an example.

Figure 3:
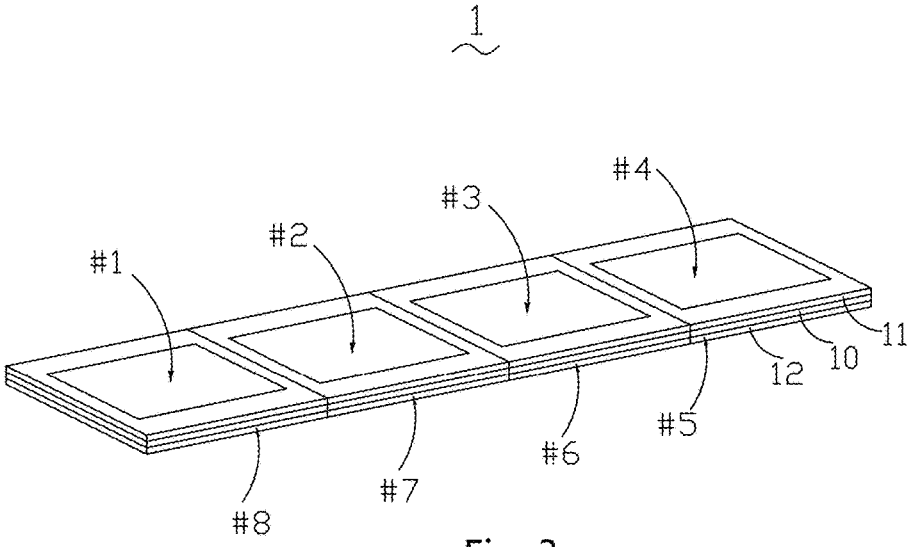
FIG. 3 is a schematic diagram of a phased array antenna system according to the second embodiment of the present invention.

In particular, the first group of antenna unit arrays 11 is formed by splicing N antenna units in a row, and the second group of antenna unit arrays 12 is formed by splicing N array of antenna units 20 in a row. The first group of antenna unit arrays 11 is formed by splicing four antenna units 20 as shown in FIG. 2 and the structure of the second group of antenna unit arrays 12 is the same as that of the first group of antenna unit arrays 11. The configuration diagram of the phased array antenna system obtained by mirroring the first group of antenna unit arrays 11 and the second group of antenna unit arrays 12 on a printed circuit board is shown in FIG. 3. The antenna unit 20 is marked as #1, #2, #3, #4, #5, #6, #7 and #8 respectively.

Optionally, the distance between each adjacent two antenna units is 4 mm (mm)-6 mm.

Figure 4:
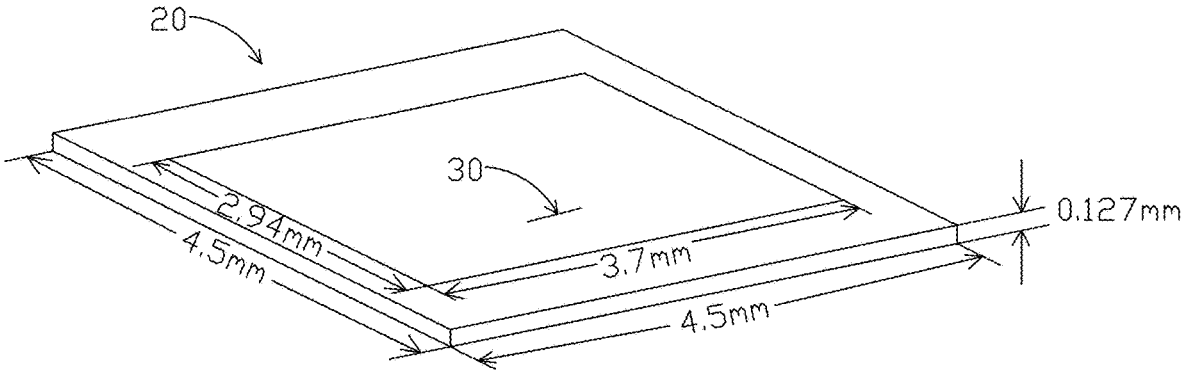
FIG. 4 is a structural diagram of an antenna unit according to the second embodiment of the present invention.
Figure 5:
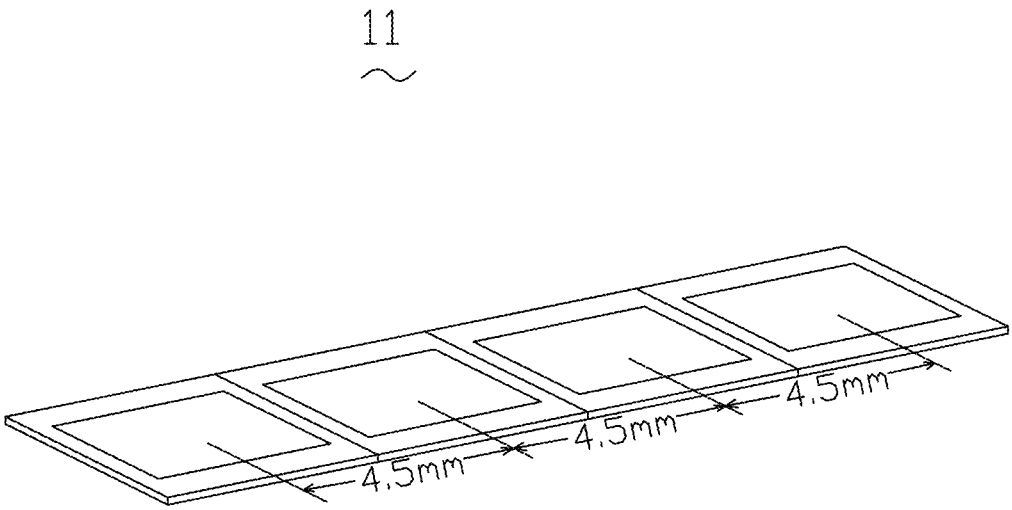
FIG. 5 is a structural diagram of a first group of antenna unit arrays according to the second embodiment of the present invention.

In a specific embodiment, the antenna unit 20 is a square with a side length of 4.5 mm. In particular, the configuration of the antenna unit 20 is shown in FIG. 4 and the antenna unit 20 is provided with a feed connection point 30, and the feed connection point 30 is located on the central axis of the antenna unit 20 and is located between 0.5 mm and −0.9 mm from the center point of the antenna unit 20. The first group of antenna unit arrays 11 is formed using the splicing of antenna units 20 shown in FIG. 4 as shown in FIG. 5.

It should be noted that only a specific way of setting a feed connection point is given here, which does not mean that the feed access point must be set in that manner. The configuration of other feed access points may also be applied in this embodiment. Of which, the feed connected by the feed access point is used to adjust the radiation power of the antenna unit.

In one specific embodiment, the phased array antenna system also includes at least one phase shifter set on a printed circuit board, and each phase shifter is connected to at least one antenna unit, and one antenna unit at least belongs to the first group of antenna unit arrays and/or a second group of antenna unit arrays. That is, a phase shifter can control an antenna unit and adjust the phase of the controlled antenna unit. Each antenna unit is provided with a phase shifter, which requires a large number of phase shifters, with high cost and hardware redundancy. Alternatively, a single phase shifter controls a plurality of antenna units, respectively adjusting the phase of each controlled antenna unit, and the plurality of antenna units controlled by the same phase shifter may all be arrays of the first group of antenna units, or both are from the second group of antenna unit arrays, or they may be partly from the first group of antenna unit arrays and partly from the second group of antenna unit arrays.

Of which, the purpose of the phase shifter to adjust the phase of the antenna unit is to adjust the main lobe direction of the antenna unit radiation, in order to improve the efficiency of receiving or transmitting data by the antenna unit.

Preferably, in the first or second embodiments, the printed circuit board is a substrate having a thickness of 5 mils, e.g.: a printed circuit board uses a RO3003 substrate.

The phased array antenna system 1 in the first or second embodiments may be used for communication in the millimeter-wave band, for example, the operating frequency band of each antenna unit in the phased array antenna system is a millimeter-wave band with a central frequency of 28 GHz.

In the phased array antenna system 1 provided by the second embodiment, full coverage of omnidirectional space can be achieved around the mobile terminal so that the terminal can receive and transmit signals in any direction and improve the efficiency of receiving and transmitting signal by mobile terminal. In addition, the mobile terminal can use fewer antenna units to achieve this goal, in order to further reduce the hardware requirements and save the cost under the condition of full coverage.

In the first or second embodiments, the antenna unit may be a patch type.

A phase shift configuration of antenna units in different positions in a phased array antenna system in the first or second embodiments is illustrated below.

Figure 6:
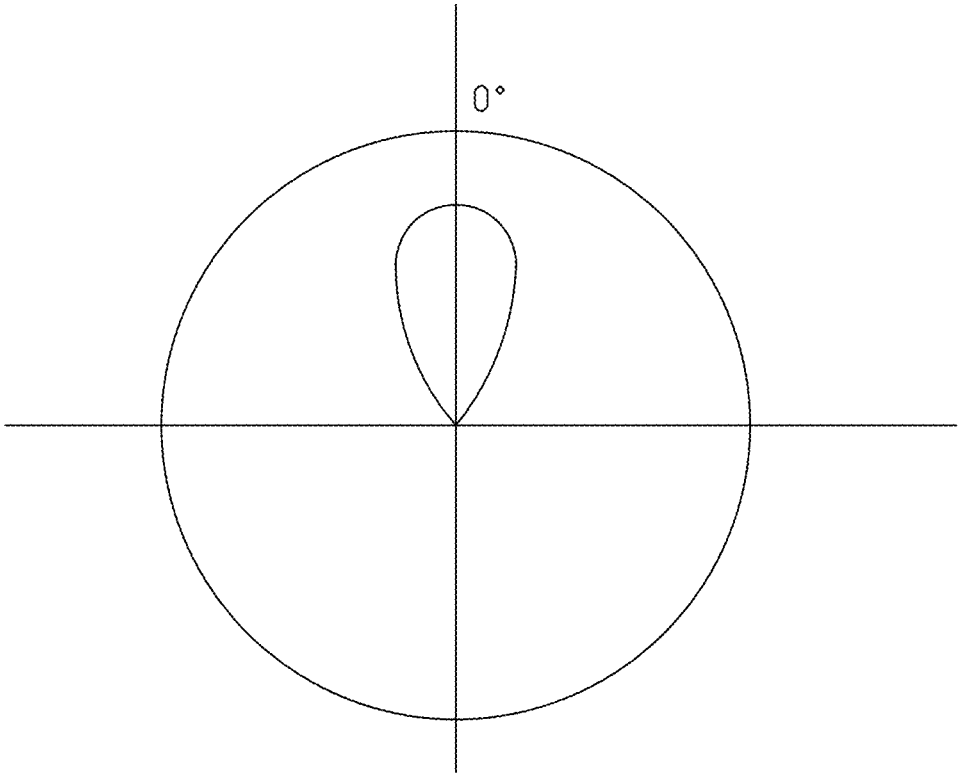
FIG. 6 is a schematic diagram of a radiation mode with a scanning angle of 0° for the first group of antenna unit arrays according to the second embodiment of the present invention.
Figure 7:
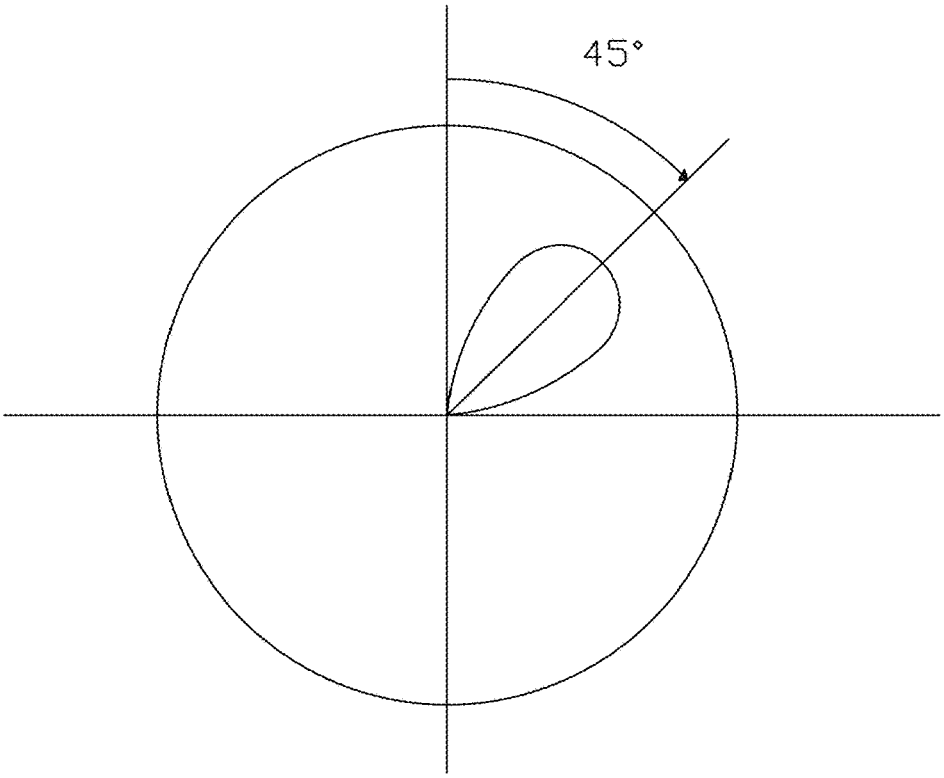
FIG. 7 is a schematic diagram of the first group of antenna unit arrays scanning an angle of 45° according to the second embodiment of the present invention.
Figure 8:
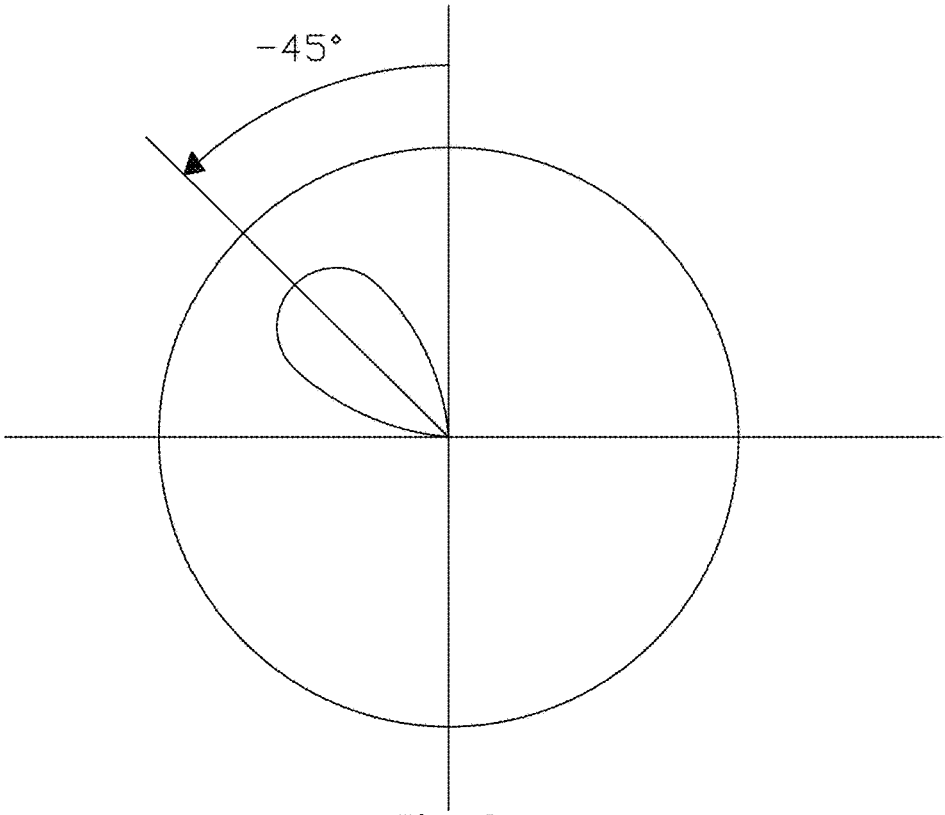
FIG. 8 is a schematic diagram of the first group of antenna unit array scanning angles of −45° according to the second embodiment of the present invention.

It is assumed that the four antenna units 20 of the first group of antenna unit arrays 11 are located at the top of the printed circuit board, and the four antenna units 20 of the second group of antenna unit arrays are located at the bottom of the printed circuit board. If the scanning angle of the first group of antenna unit array 11 is 0°, the configuration of the phase shift angle of each antenna unit in the first group of antenna units 20 is shown in Table 1. The radiation mode of the first group of antenna unit arrays 11 is shown in FIG. 6; if the scanning angle of the first group of antenna unit array 11 is 45°, the configuration of the phase shift angle of each antenna unit in the first group of antenna units 20 is shown in Table 2, and the radiation mode of the first group of antenna unit arrays 11 is shown in FIG. 7; if the scanning angle of the first group of antenna unit array 11 is −45°, the configuration of the phase shift angle of each antenna unit in the first group of antenna units 20 is shown in Table 3, and the radiation mode of the first group of antenna unit arrays 11 is shown in FIG. 8.

TABLE 1

| Scanning angle | A first group of antenna unit arrays | Antenna unit #1 | Antenna unit #2 | Antenna unit #3 | Antenna unit #4 |
|---|---|---|---|---|---|
| 0° | Phase shift angle | 0° | 0° | 0° | 0° |
| Scanning angle | A second antenna unit arrays | Antenna unit #8 | Antenna unit #7 | Antenna unit #6 | Antenna unit #5 |
| NA | Phase shift angle | NA | NA | NA | NA |

TABLE 2

| Scanning angle | A first group of antenna unit arrays | Antenna unit #1 | Antenna unit #2 | Antenna unit #3 | Antenna unit #4 |
|---|---|---|---|---|---|
| 45° | Phase shift angle | 0 | −106.989° | 146.023° | 39.034° |
| Scanning angle | A second antenna unit arrays | Antenna unit #8 | Antenna unit #7 | Antenna unit #6 | Antenna unit #5 |
| NA | Phase shift angle | NA | NA | NA | NA |

TABLE 3

| Scanning angle | A first group of antenna unit arrays | Antenna unit#1 | Antenna unit#2 | Antenna unit#3 | Antenna unit#4 |
|---|---|---|---|---|---|
| −45° | Phase shift angle | 0° | 106.989° | −146.023° | −39.034° |
| Scanning angle | A second antenna unit arrays | Antenna unit#8 | Antenna unit#7 | Antenna unit#6 | Antenna unit#5 |
| NA | Phase shift angle | NA | NA | NA | NA |

Figure 9:
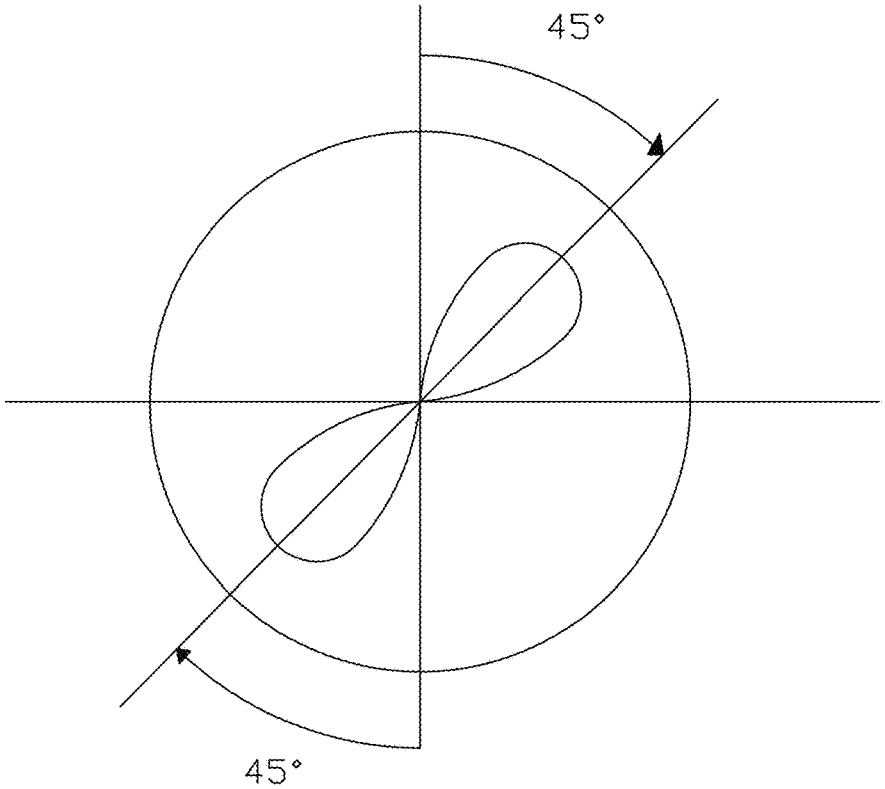
FIG. 9 is a schematic diagram of a radiation mode when the scanning angle of the first antenna unit arrays according to a second embodiment of the present invention is 45° and the scanning angle of the second antenna unit arrays is 45°.
Figure 10:
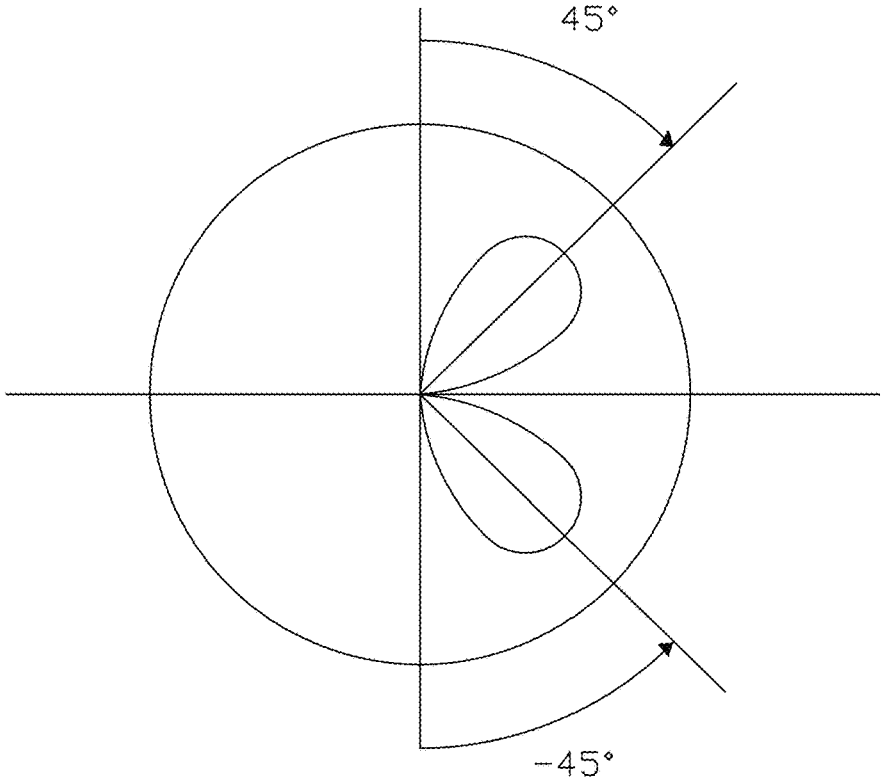
FIG. 10 is a schematic diagram of a radiation mode with a scanning angle of 45° for the first antenna unit arrays and a scanning angle −45° for the second antenna unit array according to the second embodiment of the present invention.

Similarly, the scanning angle of the second group of antenna unit arrays 12 and the configuration of the phase shift angle of the corresponding antenna unit 20 are similar to the first group of antenna unit arrays 11. For example, FIG. 9 shows a radiation mode schematic with a scanning angle of 45° for the first group of antenna unit arrays 11 and a scanning angle for the second group of antenna unit arrays 12 for 45°; FIG. 10 shows a schematic diagram of a radiation mode with a scanning angle of 45° for the first group of antenna unit array 11 and a scanning angle −45° for the second group of antenna unit array 12.

Figure 11:
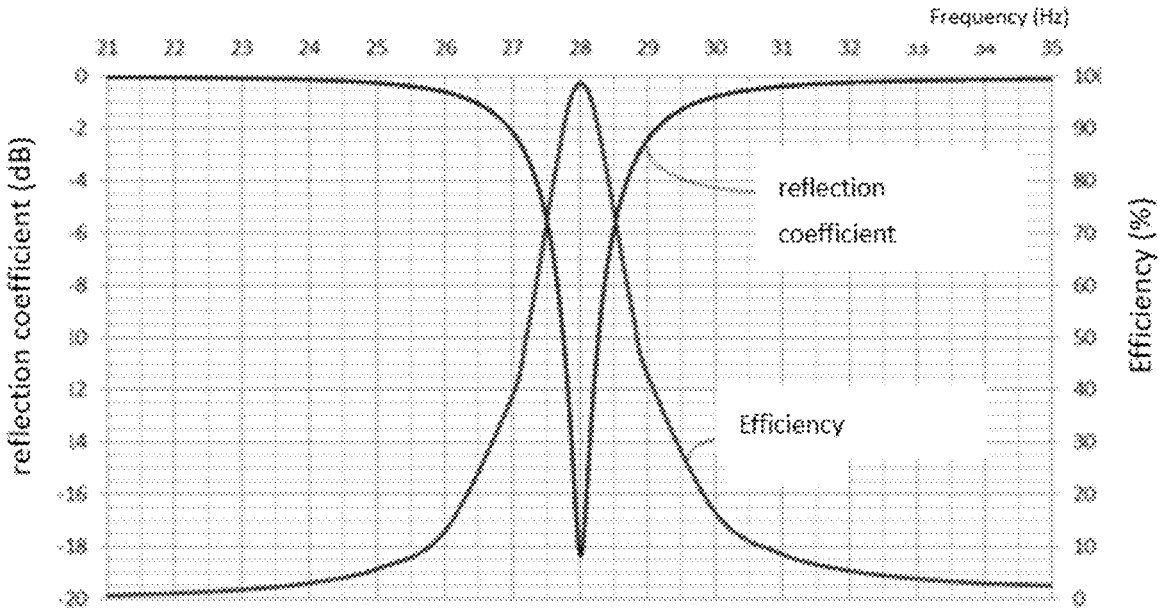
FIG. 11 is a schematic diagram of the reflection coefficient and efficiency of a single antenna unit according to the second embodiment of the present invention.
Figure 12:
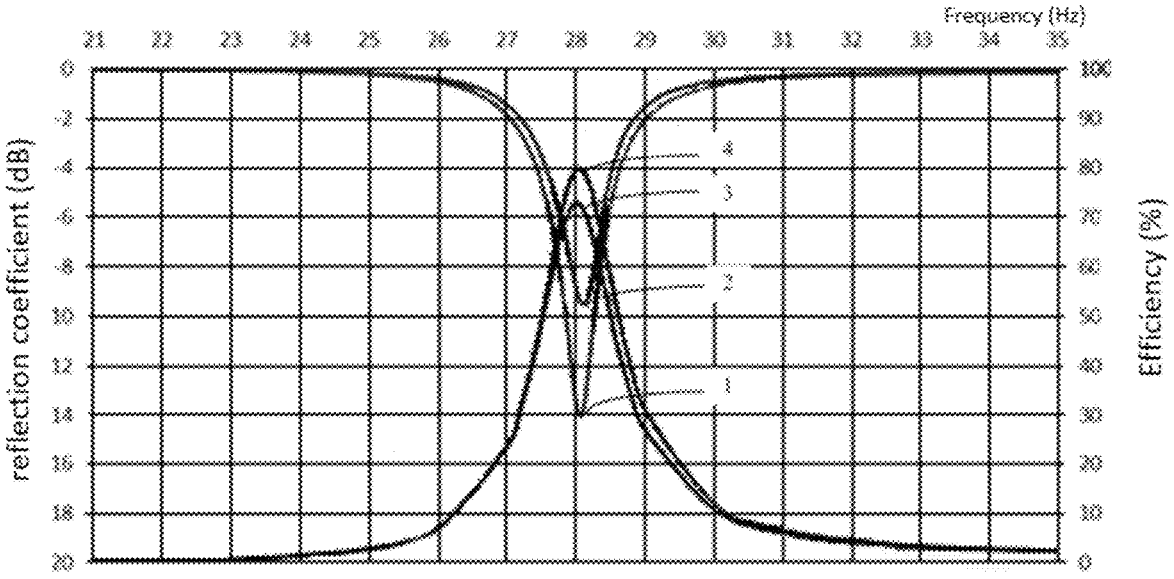
FIG. 12 is a schematic diagram of the reflection coefficient and efficiency of the phased array antenna system according to the second embodiment of the present invention.

After simulating the case where a single antenna unit 20 (i.e. when there is only one patch antenna) is used for 28 GHz millimeter-wave communications, the simulation results of the reflection coefficient and efficiency are obtained, as shown in FIG. 11. Eight antenna units 20 are spliced into a phased array antenna system in a second embodiment and are simulated for 28 GHz millimeter-wave communication. Simulation results of the reflection coefficient of each antenna unit 20 and the efficiency of the phased array antenna system are obtained as shown in FIG. 12. Of which, the reflection coefficient curve of antenna unit 20 of #1 #4 #5 and #8 is indicated by the label 1 of FIG. 12. The reflection coefficient curve of antenna unit 20 of #2, #3, #6 and #7 is indicated by label 2. Label 3 indicates an efficiency curve of phased array antenna system 1 when the scanning angle of the first group of antenna unit arrays 11 is 45°, and the scanning angle of the second group of antenna unit arrays 12 is −45°. Label 4 indicates an efficiency curve of phased array antenna system 1 when the scanning angle of the first group of antenna unit arrays 11 is 45°, and the scanning angle of the second group of antenna unit arrays 12 is 45°.

The third embodiment of the invention provides a mobile terminal comprising a phased array antenna system 1 provided by the first or second embodiments. The mobile terminal is particularly suitable for 5G mobile communication systems.

The ordinary technicians in the art can understand that the above embodiments are specific embodiments for achieving the invention. However, in practical applications, various changes can be made to them in form and in detail, without deviating from the spirit and scope of the invention.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A phased array antenna system, comprising:

a first group of antenna unit arrays;

a second group of antenna unit arrays;

a beam radiated by the first group of antenna unit arrays covering a first half space;

a beam radiated by the second group of antenna unit arrays covering a second half space; and an omnidirectional space constituted by the first half space and the second half space;

wherein the first group of antenna unit arrays is composed of N antenna units arranged in one row; the second group of antenna unit array is composed of N antenna units arranged in one row, and N is an integer greater than 1;

an operating frequency band of the antenna unit is a millimeter-wave band with a central frequency of 28 GHz;

a feed connection point is arranged on the antenna unit, and the feed connection point is located on a central axis of the antenna unit, and the feed connection point is located at 0.5 mm -0.9 mm away from the center point of the antenna unit.

2. The phased array antenna system as described in claim 1, wherein the first group of antenna unit arrays performs beam scanning in the first half space, and the second group of antenna unit arrays achieves beam scanning in the second half space.

3. The phased array antenna system as described in claim 2, wherein the first group of antenna unit arrays is arranged on one side of a printed circuit board; and the second antenna unit arrays is arranged on the other side of the printed circuit board and is arranged mirroring to the first group of antenna unit arrays.

4. The phased array antenna system as described in claim 1, wherein the first group of antenna unit arrays is formed by splicing N antenna units arranged in one row; and the second group of antenna unit arrays is formed by splicing N antenna units arranged in one row.

5. The phased array antenna system as described in claim 1, wherein the N is equal to 4.

6. The phased array antenna system as described in claim 5, wherein a distance between two adjacent antenna units is 4 mm –6 mm.

7. A mobile terminal including the phased array antenna system as described in claim 1.

* * * * *